US005782463A

United States Patent [19]

Campolito

[11] Patent Number: 5,782,463

[45] Date of Patent: Jul. 21, 1998

[54] PISTON RING FILING JIG

[76] Inventor: Dino Campolito, 4545 Quaker Ct., Canfield, Ohio 44406

[21] Appl. No.: 725,671

[22] Filed: Oct. 1, 1996

[51] Int. Cl.[6] ..... B25B 1/00

[52] U.S. Cl. ..... 269/87.1; 269/296; 269/298

[58] Field of Search ..... 76/78.1, 79.5, 76/80.5; 451/369–371; 29/76.1; 269/279–284, 155, 156, 87.1, 87.2, 261, 296, 298, 909

[56] References Cited

U.S. PATENT DOCUMENTS

| | | | |
|---|---|---|---|
| 789,405 | 4/1905 | Ascher | 269/282 |
| 1,442,932 | 1/1923 | Fegely et al. . | |
| 1,452,518 | 4/1923 | Mainwaring . | |
| 1,481,595 | 1/1924 | Flanders . | |
| 1,513,073 | 10/1924 | Thurston . | |
| 1,865,388 | 6/1932 | Ralph . | |
| 2,007,490 | 7/1935 | Zimmerman . | |
| 2,401,054 | 5/1946 | Daley | 269/279 |
| 3,982,740 | 9/1976 | Gutman | 269/155 |
| 5,037,075 | 8/1991 | Durfee | 269/281 |
| 5,419,540 | 5/1995 | Teafatiller | 269/261 |
| 5,577,717 | 11/1996 | Benson | 269/87.2 |
| 5,657,974 | 8/1997 | Williams | 269/231 |

*Primary Examiner*—Robert C. Watson
*Attorney, Agent, or Firm*—Harpman & Harpman

[57] ABSTRACT

A tool for measuring and filing the end gaps of piston rings to achieve a correct right angle end surface. The tool includes a support base and adjustable piston ring clamp. A ring stop adjustably determines the proper "gap" of the ring material to be removed while the support base provides a guide surface for a file to remove and dress the ring end surface.

7 Claims, 4 Drawing Sheets

PISTON RING FILING JIG

BACKGROUND OF THE INVENTION

1. Technical Field

This device relates to piston ring filing devices that are used to hold and file the end of a piston ring required to achieve proper ring fit on a piston.

2. Description of Prior Art

Prior art devices of this type have relied on a variety of different piston ring filing devices that hold and measure rings to be filed, see for example U.S. Pat. Nos. 1,442,932, 1,452,518, 1,481,595, 1,513,073, 1,865,388 and 2,007,490.

U.S. Pat. No. 1,442,932 is directed to a work holder for piston rings to hold same in horizontal position for filing the upper and lower surfaces. The device also holds the rings in vertical position for end lapping or fitting.

U.S. Pat. No. 1,452,518 discloses a piston ring holder to allow flush filing of the ring ends with the tapered guide surface.

U.S. Pat. No. 1,481,595 shows a piston ring filing device that holds the ends of the ring in a fixed position so the ends can be filed within an angled guide groove.

In U.S. Pat. No. 1,513,073 a piston ring clamp and file guide is illustrated having a clamping configuration and multiple guide slots.

U.S. Pat. No. 1,865,388 discloses a piston ring gauge wherein a fitted piston ring is positioned therein and the gauge set and removed. A new ring then can be fitted within the gauge matching the correct settings hereinbefore achieved.

U.S. Pat. No. 2,007,490 is directed to a ring filing device wherein a file is mounted within a bracket. The piston ring is secured in a sliding guide plate so that the respective ends of the piston ring can be filed at 90 degrees by reciprocating the ring thereacross the file.

Finally, in U.S. Pat. No. 5,038,449 a piston ring end gap tool is disclosed that holds a piston ring for positioning within a cylinder bore for fitting.

SUMMARY OF THE INVENTION

A piston ring tool for holding and filing the ends of a piston ring in aligned relationship with one another by precisely setting the amount of material to be removed. The piston ring end is adjustably held against a guide end stop surface that is preset to the removal amount by interchangeable gauge shims. A large filing guide surface maintains a manually engaged file in correct alignment for precise piston end filing.

DESCRIPTION OF THE PREFERRED EMBODIMENT

Figure 1:
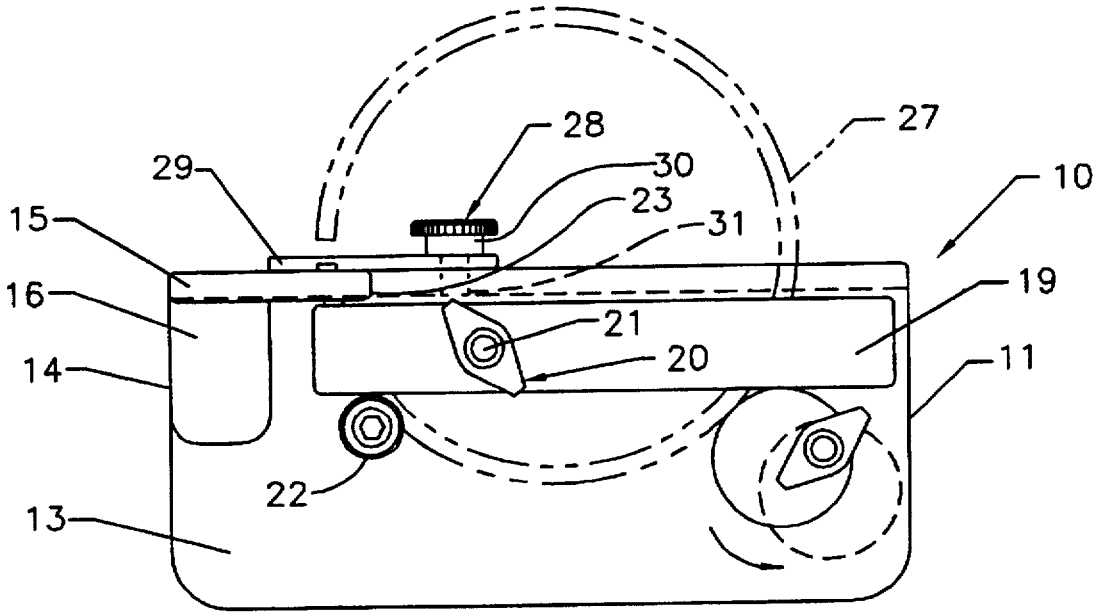
FIG. 1 is a front elevational view of the piston ring filing device.
Figure 2:
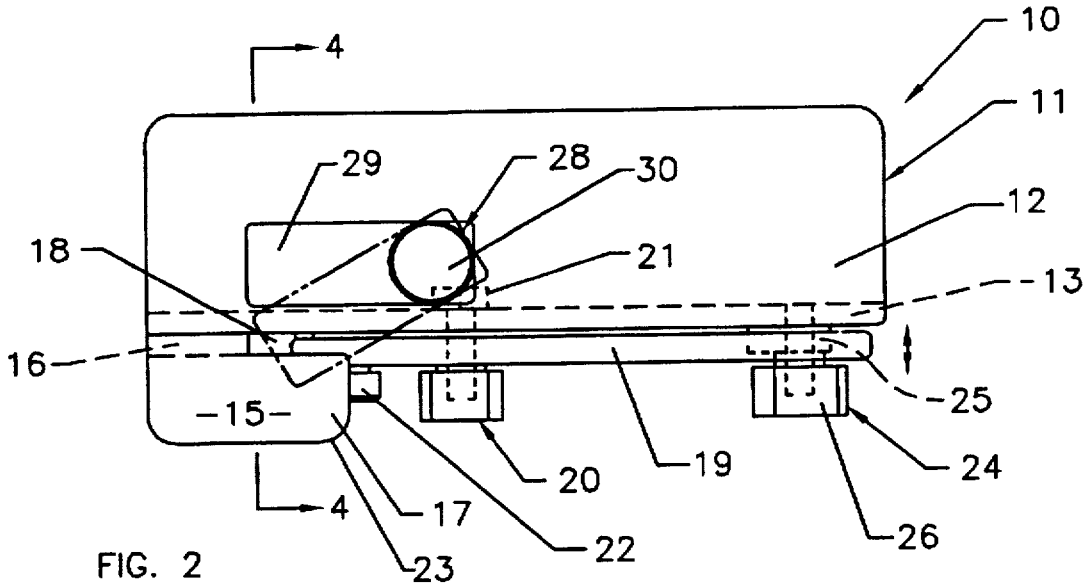
FIG. 2 is top plan view of the piston ring filing device.
Figure 3:
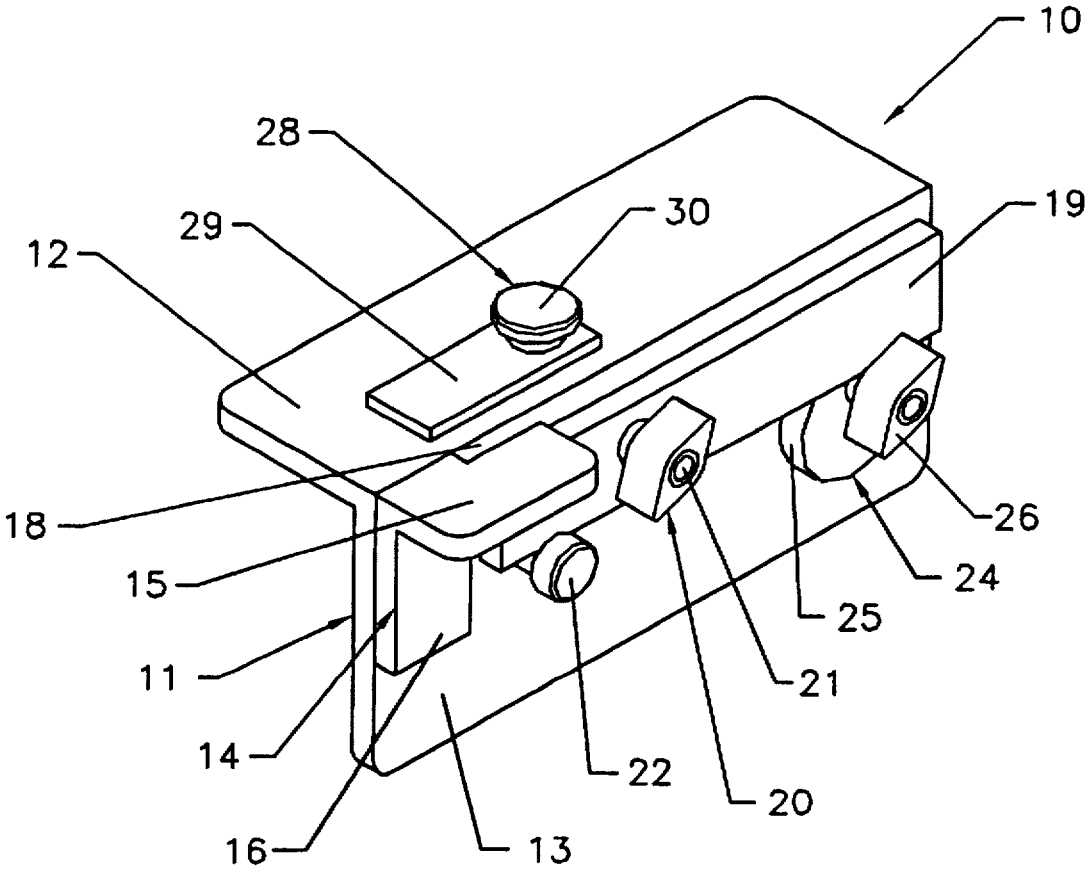
FIG. 3 is a perspective view of the piston ring filing device.
Figure 4:
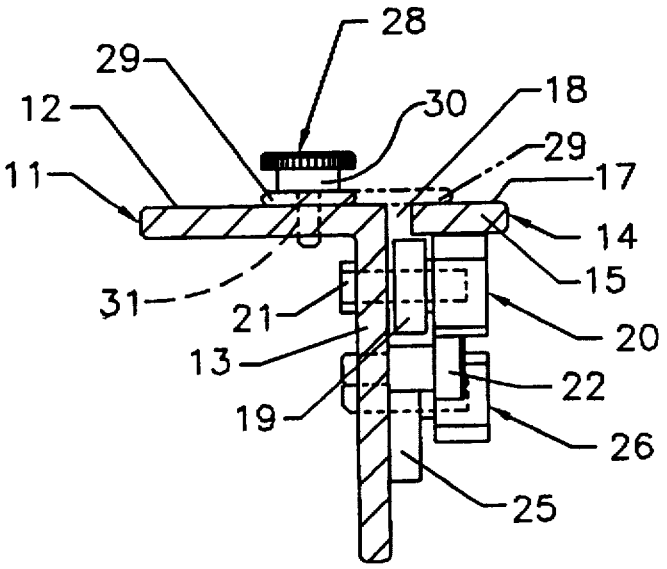
FIG. 4 is a section on lines 4—4 of FIG. 2.

Referring to FIGS. 1, 2, and 3 of the drawings, a piston ring filing tool 10 can be seen having a main elongated L-shaped body member 11 with an upper rectangular guide surface 12 and right angular descending clamping and mounting plate 13. A filing guide angle iron 14 extends from an end portion of the clamping and mounting plate 13. The angle iron 14 has an upper guide plate 15 and a descending mounting plate 16. The upper guide plate 15 defines a guide surface 17 in planar relationship with said upper guide surface 12. The upper guide plate 15 extends beyond the mounting plate 16 defining a piston ring receiving area at 18 therebetween. A ring clamping plate 19 is adjustably secured to the mounting plate 13 adjacent said angle iron 14 in vertically spaced relation to the guide surface 12 of said body member 11. The ring clamping plate 19 is adjustably secured to the mounting plate 13 by a threaded wing nut assembly 20 having a mounting bolt 21 extending through aligned apertures in both of said mounting plate 13 and clamping plate 19 as will be understood by those skilled in the art. A first ring guide 22 is threadably secured to the mounting plate 13 adjacent said clamping plate 19 in vertical alignment with and an edge 23 of the upper guide plate 15, best seen in FIGS. 1 and 2 of the drawings. A second ring guide 24 is adjustably secured to the mounting plate 13 in spaced relation to said first ring guide 22 adjacent the oppositely disposed end portion of said clamping and mounting plate 13. The second ring guide 24 has a cammed surface at 25 with a threaded adjustable wing nut assembly 26 so that by rotation of the cam surface 25 different diameter piston rings 27 (shown in broken lines in FIG. 1 of the drawings) can be accommodated as will be described in greater detail hereinafter. A ring stop gauge assembly 28 is pivotally secured to the upper guide surface 12. The ring stop gauge assembly 28 has a generally rectangular stop plate 29 apertured inwardly from one end to receive a binding screw 30 threadably engaged into the upper guide surface 12 in a threaded aperture 31 therein. The ring stop gauge assembly 28 is so positioned that the stop plate 29 can be pivoted to overlie the ring guide area 18 between the respective upper guide surfaces 12 and 17 as hereinbefore described and illustrated in broken lines in FIG. 2 of the drawings.

Figure 5:
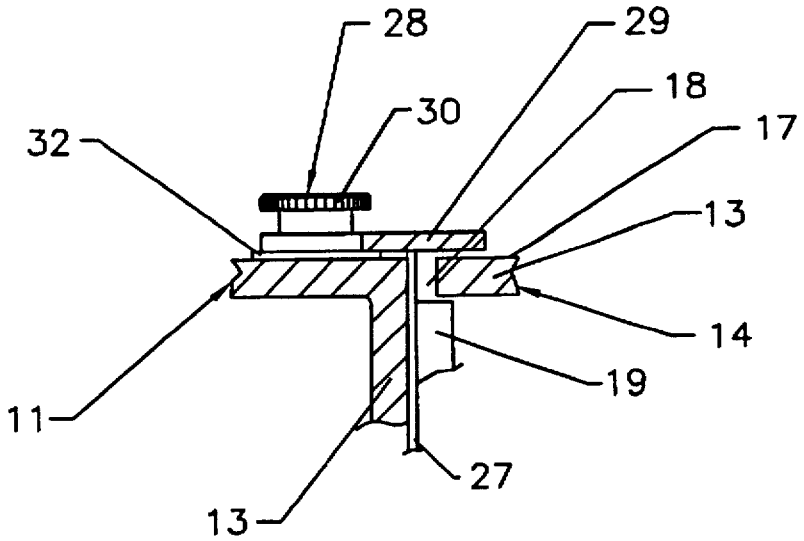
FIG. 5 is an enlarged partial cross-sectional view of the device with a piston ring positioned within engaged against the end stop guide.
Figure 6:
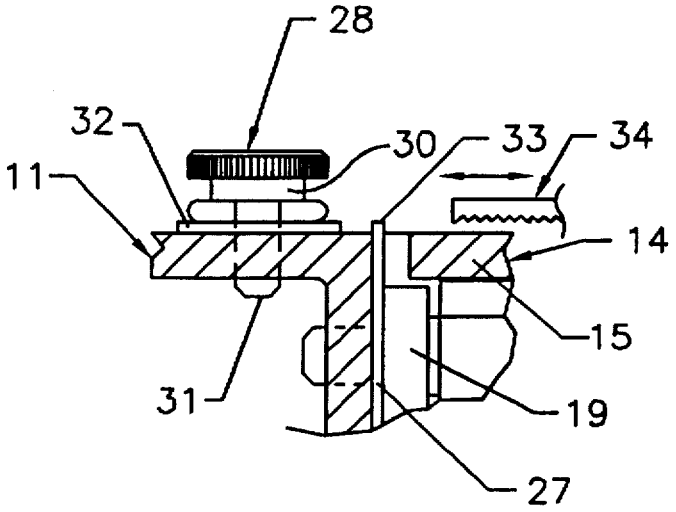
FIG. 6 is an enlarged partial end view of the device with a piston ring within ready for filing.

Referring now to FIGS. 1, 5, and 6 of the drawings, the piston ring filing tool 10 of the invention can be seen in use wherein the piston ring 27 shown in solid lines in FIGS. 5 and 6 is positioned between the mounting plate 13 and clamping plate 19. The second guide ring rest 24 is adjusted by rotation of the camming surface 25 to match the piston ring 27's respective size.

A shim gauge 32, best seen in FIGS. 2 and 5 of the drawings corresponds to the desired amount of ring gap to be removed is positioned under the stop plate 29 spacing same in relation to the upper guide surface 12. The shim gauge 32 is one of a selected group of shims (not shown and readily available), each having a different thickness between the ranges of 0.002" and 0.050" to effectively encompass in varied combinations all of the expected gauge amounts to be removed in this application. The stop plate 29 is pivoted on its binding screw 30 to overlie the piston receiving area 18 as seen in FIGS. 3 and 5 of the drawings in elevated position. The piston ring 27 is then advanced against the respective first and second ring guides 21 and 24 for abutting engagement against the stop plate 29. The clamping plate 19 is tightened against the piston ring 27 holding same in secured relationship between the clamping plate 19 and mounting plate 13. The binding screw 30 is loosened and the stop plate 29 moved away, as best seen in FIG. 6 of the drawings.

The upstanding portion 33 of the piston ring 27 to be removed extends above the planar surface of the respective guide surfaces 12 and 17. A metal file 34 well known to those skilled in the art is applied to the upstanding ring portion 33 removing same. The file 34 engages the respective upper guide surfaces 12 and 17 assuring a (square) end surface on the piston ring 27 and correct amount of ring material removal during filing. The piston ring 27 is removed and reversed for repositioning to file the remaining piston ring end as will be well known to those skilled in the art.

It will also be apparent that for use the piston ring filing tool 10 must be secure in a tool vice (not shown) or clamped to a secure surface by its descending clamping and mounting plate 13.

The piston ring filing tool 10 of the invention enables both ends of the piston ring 27 to be filed a precise amount assuring a precision fit of the piston ring.

Thus, it will be seen that a new and novel piston ring filing tool has been illustrated and described and that various changes and modifications may be made therein without departing from the spirit of the invention.

Therefore I claim:

1. A piston ring clamp and filing guide comprising; a main body member having a mounting portion, guide insert surfaces extending from said mounting portion, piston ring securing means and adjustable ring engagement guides secured to said mounting portion, said guide surfaces and said main body member defining a ring receiving area therebetween, a ring end stop positioned on one of said guide surfaces, shim spacers for selectively spacing said ring end stop from said guide surfaces, means for pivoting said ring end stop on said guide surfaces and means for selective adjustment of said ring engagement guides in relation to one another.

2. The piston ring clamp and filing guide of claim 1 wherein said piston ring securing means comprises; a clamping plate selectively engageable against said mounting portion inwardly from said guide surfaces.

3. The piston ring clamp and filing guide of claim 1 wherein said means for selective adjustment of said ring engagement guides comprises; a movable cam surface on one of said guides.

4. The piston ring clamp and filing guide of claim 1 wherein said guide surfaces comprises; a first guide surface extending at right angles from said main body mounting portion, a second guide surface in co-planar relation to said first guide surface.

5. The piston ring clamp and filing guide of claim 1 wherein said means for selective spacing of said ring end stop from said guide surfaces are removably positioned between said end stop and one of said guiding surfaces adjacent said pivoting means thereon, said shim spacers having a known thickness from a group consisting of a range between 0.002" to 0.050".

6. The piston ring clamp and filing guide of claim 1 wherein said ring end stop is movable from a first position on one of said guide surfaces to a second position overlying said ring receiving area and said second guide surface and back to a first position.

7. The piston ring clamp and filing guide of claim 4 wherein said first guide surface is notched adjacent said second guide surface.

* * * * *